United States Patent [19]

Jepsen

[11] 4,389,858

[45] Jun. 28, 1983

[54] HEAT ENGINE

[76] Inventor: Henry E. Jepsen, 10360 Santa Gertudes #36, Whittier, Calif. 90603

[21] Appl. No.: 304,071

[22] Filed: Dec. 3, 1981

[51] Int. Cl.[3] ..... F25B 1/00

[52] U.S. Cl. ..... 62/498; 62/510

[58] Field of Search ..... 62/116, 498, 500, 510, 62/215, 191, 230

[56] References Cited

U.S. PATENT DOCUMENTS

| | | | |
|---|---|---|---|
| 2,494,120 | 1/1950 | Ferro, Jr. | 62/510 X |
| 2,519,010 | 8/1950 | Zearfoss, Jr. | 62/116 |
| 3,172,270 | 3/1965 | Mirante | 62/116 |
| 3,277,658 | 10/1966 | Leonard, Jr. | 62/116 X |
| 3,367,125 | 2/1968 | McGrath | 62/116 |
| 3,934,424 | 1/1976 | Goldsberry | 62/498 X |

*Primary Examiner*—Lloyd L. King

*Attorney, Agent, or Firm*—Fulwider, Patton, Rieber, Lee and Utecht

[57] ABSTRACT

This heat-activated refrigeration system couples a heat pump to a rotary fluid motor and starting means. The heat pump cycle maintains the system in thermal equilibrium by replacing energy leaving a regenerative refrigerant cycle. A shaft from the rotary fluid motor drives the compressor. The compressor discharge line branches so that one line couples to the rotary fluid motor to drive it, while the other line delivers refrigerant to a heat pump. Return flow from the fluid motor and return flow from the heat pump converge at the compressor suction line. The system can function as a heat engine with a power take-off shaft, or it can function as an ambient heat-activated refrigeration system, depending upon the size of its system components.

9 Claims, 3 Drawing Figures

HEAT ENGINE

FIELD OF THE INVENTION

The invention involves two refrigerant cycles which are used in ambient heat-activated refrigeration systems and in engines which use ambient heat for their energy input.

BACKGROUND OF THE INVENTION

Refrigeration systems absorb ambient heat in the area of their evaporator and they release heat in the area of their condenser.

Heat-activated refrigeration systems differ from vapor-compression refrigeration systems in that their compressors are driven by refrigerant turbines, or the like. Refrigerant heat to activate the turbine is wholly or partially obtained from an external source. Prior art recognizes that excess energy to the compressor could be used at a power take-off shaft.

Examples of heat-activated refrigeration systems are taught by U.S. Pat. Nos. 2,486,034; 2,511,716; 2,737,031; 3,172,270 and 3,400,555.

SUMMARY OF THE INVENTION

The invention consists of a heat-activated refrigeration system with an improved method of heat energy conversion. The method incorporates a regenerative refrigerant cycle and a heat exchanger in the system so as to retain most of the system's working fluid in its superheated gaseous state. This heat would otherwise be wasted by allowing the refrigerant to return to its liquid state at a condenser, or other condensing means.

The heat pump subsystem absorbs ambient heat energy at the evaporator. This heat compensates for thermal losses at the regenerative refrigerant cycle as it is converted into shaft-work.

The invention can serve either as an ambient heat-activated refrigeration system, or as a heat engine, depending upon the sizing of its components. It will hereafter be disclosed in its heat engine context.

The engine is started by shutting off the by-pass valve between the high-pressure side and the low-pressure side of the system. Then, the starter compressor motor is started up to pressurize the engine. Forces acting within the fluid motor can then be converted into shaft-work. The engine is stopped by opening the by-pass valve and equalizing pressures throughout the engine.

A capacity control slide valve in the compressor adjusts the engine speed by varying the amount of fluid which flows through the positive displacement fluid motor.

In very cold weather the engine is energized by routing heat to the evaporator from an auxiliary heat source.

DESCRIPTION OF THE PREFERRED EMBODIMENT

Figure 1:
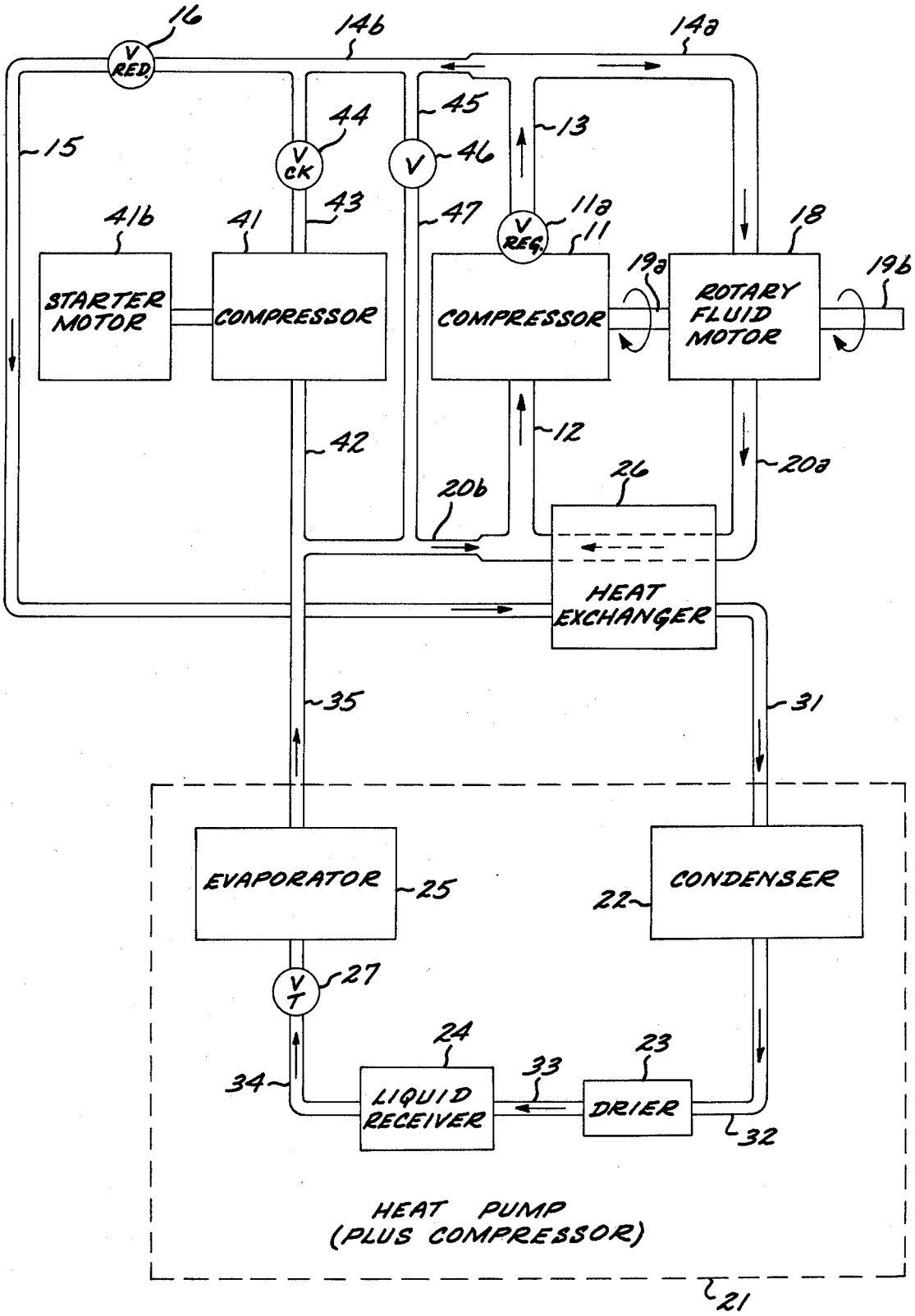
FIG. 1 is a schematic diagram of the heat-activated refrigeration system showing the invention in a heat engine.

Referring to FIG. 1 of the drawings, the heat engine includes a fluid compressor 11 with a suction line 12 and a discharge line 13. Discharge line 13 branches into lines **14*a* and 14*b*. Line 14*a* coupled to fluid motor 18. Line 14*b* couples through a restrictor 16 to heat exchanger inlet line 15. Fluid flow through motor 18 causes the rotation of shafts 19*a* and 19*b*. Compressor 11 is driven by shaft 19*a* while work is coupled from power take-off shaft 19*b*. The outlet port of motor 18 couples to the compressor suction port through lines 20*a* and 12. Capacity control slide valve 11*a* in compressor 11** is used to adjust the engine shaft speed.

Refrigerant is circulated through the heat pump to absorb ambient heat. Refrigerant from the heat pump is mixed with superheated refrigerant coming from the fluid motor at the regenerative refrigerant cycle to compensate for enthalpy heat losses by the heat engine. Refrigerant flowing through the heat pump cools down to its liquid state in condenser 22. Any moisture is removed from the refrigerant by drier 23 before it collects in receiver 24. Thermostatic expansion valve 27 regulates the amount of liquid refrigerant flowing through evaporator 25 to meet changing load conditions. Ambient heat picked up at evaporator 25 causes the refrigerant to become superheated. Heat exchanger 26 increases the heat engine's efficiency by transferring heat from heat exchanger inlet 15 to compressor suction line **20*a*. Arrowheads show the direction of refrigerant flow in lines such as 31, 32, 33, 34 and 35**.

The heat engine stops when the engine pressures are equalized by opening by-pass valve 46. To re-start the engine, by-pass valve 46 is closed, shutting off high-pressure line 45 from low-pressure line 47. Then starter motor **41*b* drives starter compressor 41 until the pressure differential is reached and check valve 44 closes. Only the heat engine version of the invention has power take-off shaft 19*b***.

Figure 2:
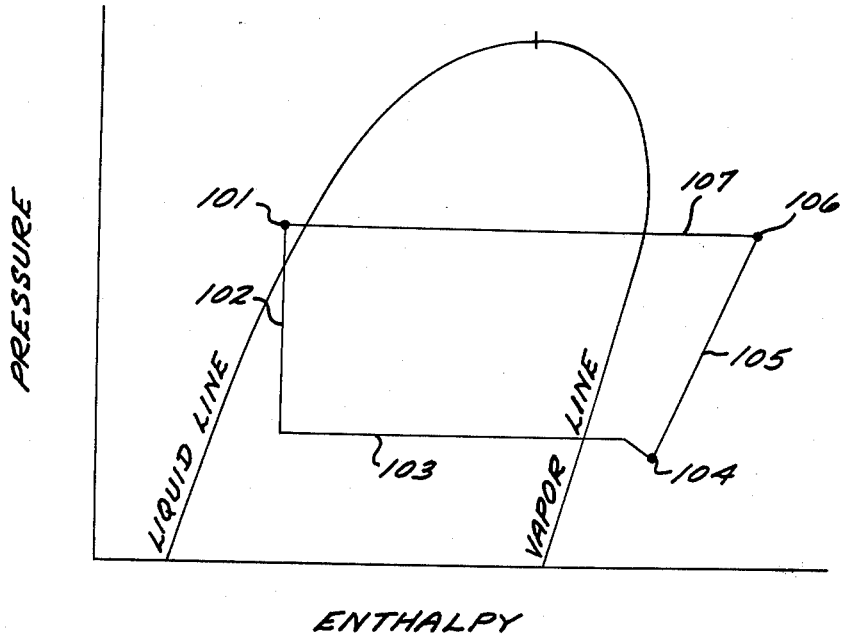
FIG. 2 is a pressure-enthalpy diagram for a Freon refrigerant, showing the system's heat pump cycle.
Figure 3:
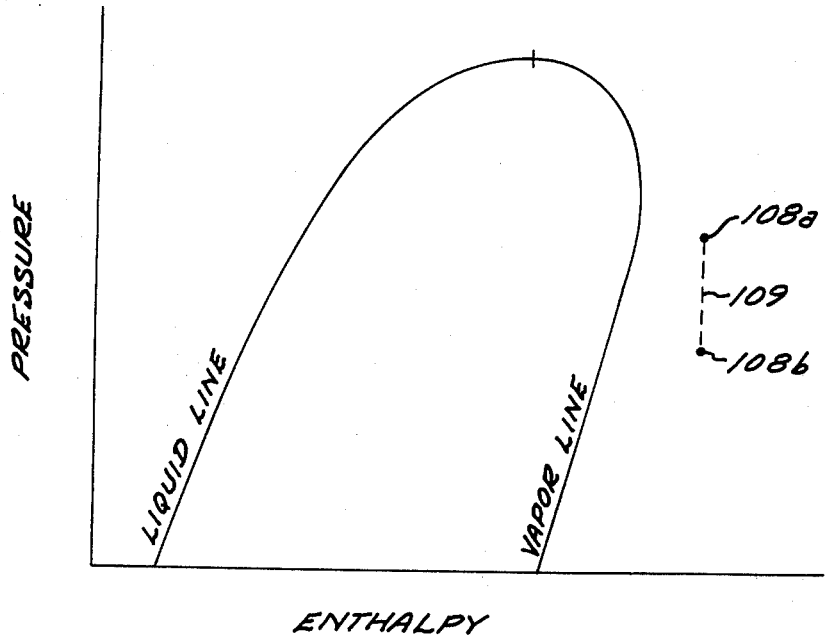
FIG. 3 is a diagram of the baseline enthalpy for a Freon refrigerant in the system's regenerative cycle.

FIGS. 2 and 3 are diagrams which show the two refrigerant cycles. Refrigerants like R-13B1 are marketed by the Du Pont Company under the trade-name of FREON. The term "Freon" will be used for the working fluid in the heat-activated refrigeration system and the heat engine. FIG. 2 shows the changes taking place in the Freon during a heat pump cycle by means of a pressure-enthalpy diagram. The Freon expands when it passes through expansion valve 27, as line 102 indicates. Line 103 indicates that heat is absorbed by Freon to state-point 104 at compressor suction line 12. The heat of compression is added to the Freon along line 105 until it reaches state-point 106 at the compressor discharge. The compressor discharge line branches so that some Freon goes to drive the fluid motor and the rest returns to the heat pump cycle. Some of the Freon's heat is converted to shaft-work as it passes through the fluid motor. Freon going to the heat pump cycle passes through a heat exchanger 26 which transfers most of its heat to the regenerative cycle before it liquifies in condenser 22 at state-point 101.

FIG. 3 diagrams the baseline enthalpy for Freon in the regenerative refrigerant cycle. Heat is added from the heat pump cycle to compensate for enthalpy losses as Freon heat is converted to shaft-work. The Freon increases in enthalpy as it mixes with warmer Freon from the heat pump cycle. This Freon expands from state-point **108*a* to state-point 108*b* along line 109 in compressor suction lines 20*a* and 12. The Freon contracts from state-point 108*b*, along line 109, to state-point 108*a*. The contraction occurs in lines 13, 14*a* and 14*b***.

Having described the preferred embodiment of my invention, one skilled in the art, after studying the above description of my preferred embodiment, could devise other embodiments without departing from the spirit of my invention. Therefore, my invention is not to be considered as limited to the disclosed embodiment, but includes all embodiments falling within the scope of the appended claims.

I claim:

1. A heat-activated refrigeration system for performing shaft-work comprising:

a rotary fluid motor having an inlet for a refrigerant gas, an outlet for said refrigerant and a power take-off shaft to obtain work from said rotary fluid motor;

a refrigerant compressor means having an inlet for said refrigerant, an outlet for said refrigerant and a rotatably mounted shaft by which said compressor may be driven;

connecting means between said shaft of said compressor and said shaft of said rotary fluid motor by which said compressor is driven by said rotary fluid motor;

heat pump means to absorb heat from an ambient source;

a refrigerant flowing through said heat pump, said compressor and said rotary fluid motor;

connecting means by which refrigerant flow from said heat pump and the outlet of said rotary fluid motor are connected to the inlet of said compressor; and connecting means by which the inlet of said heat pump and the inlet port of said fluid motor are connected to the outlet port of said compressor whereby the flow rate of said refrigerant is regulated.

2. A heat engine as in claim 1 wherein said heat engine further comprises an engine stopping means consisting of a by-pass valve between the high-pressure side and the low-pressure side of the system.

3. A heat engine as in claim 1 which further comprises:

an engine starting means consisting of an auxiliary refrigerant compressor means with the discharge port of said auxiliary compressor connected to the inlet of a check valve, said check valve preventing flow of fluid into said discharge port; and said starting means being connected between the high-pressure side and the low-pressure side of the system.

4. A heat engine as in claim 1 which further comprises heat exchanger means between the refrigerant flow inlet to the heat pump and the refrigerant flow inlet to the compressor.

5. A heat engine as in claim 1 which further comprises restriction means between the outlet of said compressor means and the inlet of said heat pump condenser means.

6. A heat engine as in claim 1 which further comprises control means for varying the speed of operation of said fluid driven motor.

7. A heat engine as in claim 6 in which said control means comprises flow regulation means in the compressor for said refrigerant.

8. A heat engine as in claim 1 which further comprises two refrigerant cycles, consisting of a heat pump cycle and a regenerative refrigerant cycle.

9. A heat-activated refrigeration system as in claim 1 wherein said refrigeration system removes heat from a closed area or supplies heat to a closed area.

* * * * *